United States Patent [19]

Chapman, Jr.

[11] Patent Number: 4,523,498

[45] Date of Patent: Jun. 18, 1985

[54] ERGONOMICAL IN-LINE TOOL

[75] Inventor: Ivan B. Chapman, Jr., Baltimore, Md.

[73] Assignee: AT&T Technologies, Inc., Berkeley Heights, N.J.

[21] Appl. No.: 463,189

[22] Filed: Feb. 2, 1983

[51] Int. Cl.[3] ..... B25B 13/00

[52] U.S. Cl. ..... 81/177.1; 16/116 R

[58] Field of Search ..... 16/116 R, DIG. 12, 40; 81/177 R, 180 R

[56] References Cited

U.S. PATENT DOCUMENTS

| | | | |
|---|---|---|---|
| 1,690,312 | 11/1928 | Rosan . | |
| 2,274,605 | 2/1942 | Hoffmeister | 16/DIG. 12 X |
| 2,717,437 | 9/1955 | Mestral . | |
| 3,072,955 | 1/1963 | Mitchell | 16/116 R X |
| 3,084,938 | 4/1963 | Kapanowski . | |
| 3,739,932 | 6/1973 | Westover | 16/116 R X |
| 4,249,689 | 2/1981 | Voytko . | |
| 4,330,093 | 5/1982 | Chapman . | |

OTHER PUBLICATIONS

"Human Factors Engineering Bulletin"; Clear Vinyl Flanged Grips; May, 1971.

*Primary Examiner*—James G. Smith
*Attorney, Agent, or Firm*—E. W. Somers

[57] ABSTRACT

An in-line tool (20) is provided with a jacket (50) which includes a flexible substrate material (53) having a plurality of ribs (51—51) adhered thereto. The jacket is such that when it is wrapped about a barrel (41) of the tool, the ribs extend longitudinally along the tool barrel. The substrate material between adjacent ribs may be cut to provide a jacket which is tailored to the barrel of a particular size tool. Strips (55, 56 and 59) of material having relatively flexible hooking and looping elements projecting therefrom are attached to the jacket and to the barrel. When the jacket is wrapped about the barrel, the hooking and looping elements interlock to secure the jacket to the barrel. Tabs (54—54) extend laterally of the barrel from an end of each of a predetermined number of ribs adjacent to a working portion (40) of the tool. A user grasps the tool in a manner to cause the ulnar side (48) of the gripping hand (43) to engage the tabs. This allows the tool to be moved toward a workpiece by forces applied through the ulnar side of the hand.

6 Claims, 10 Drawing Figures

ERGONOMICAL IN-LINE TOOL

TECHNICAL FIELD

This invention relates to an ergonomical in-line tool, and, more particularly, to an ergonomically designed tool which is used to perform repetitive operations such as for example in the manufacture of terminal blocks of the type used in the telecommunications industry.

BACKGROUND OF THE INVENTION

The manufacture of particular equipment for the telecommunications industry often requires repetitive tool movements by an operator who is sitting or standing at a work position. One commonly used piece of equipment is a terminal block which includes a plastic carrier having a plurality of metallic terminals mounted therein. Typically, portions of the terminals extend from the plastic carrier and are adapted to have conductors wrapped therabout in close-fitting relation to establish electrical connections. In other applications, nuts must be turned into terminal nests or screws turned into sockets. The wrapping of conductors about these terminals or the turning of screws or nuts is generally accomplished in a factory environment by an operator who uses a tool throughout a work shift. The typical tool for these kinds of applications is pneumatically operated and includes a barrel and a working portion such as a bit, for example, which includes an opening for receiving a terminal to be wrapped.

In some instances, it is best to position the workpiece so that the tool is moved horizontally inwardly and then withdrawn in each cycle of operation. For those, the tool is generally hand-held through a pistol-type grip which is attached to the barrel. For example, see U.S. Pat. No. 4,330,093 which issued on May 18, 1982 in the name of I. B. Chapman.

In an alternate method, the workpiece is supported in a manner which requires that the tool be moved vertically. For this workpiece orientation, a tool which is characterized as being in-line or straight is used. In such a tool, a motor, and a barrel are in-line. There is no pistol-type grip; instead, the barrel is gripped by the operator. The tool is moved vertically from a rest position in which it is suspended above the workpiece to a work-engaging position where the bit engages the workpiece.

The movement of the in-line tool in a vertical manner may cause biomechanical problems for the operator because of the relative vertical locations of the rest position of the suspended in-line tool and of the workpiece. The grasping of the barrel in the rest position by the operator may result in what is referred to as an ulnar deviation of the forearm. The ulnar bone deviates from its normal anatomical position with respect to bones in the carpal tunnel area of the hand. This causes compresssion of bones in the carpal tunnel area and extension of muscles of the forearm. Over a period of time, repetitive extension together with a relatively tight grip, which is necessary to move the tool downwardly against the upward bias of a tool support system, may result in operator fatigue and in product defects.

This last mentioned problem has been addressed by a prior art arrangement in which the barrel is fitted with a molded sleeve having a flange at one end thereof. The sleeve is made of plastic and is caused to contract about the barrel to become secured thereto. The flange is engaged by the ulnar side of a user's hand which grips the sleeved barrel. This facilitates the application of forces to the tool to move it downwardly from the rest position to the work-engaging position without requiring the relatively tight grip as before. Inasmuch as the sleeve must be cut in order to be removed, it is important that it not extend beyond the barrel; otherwise, it would be difficult to replace or to repair the working portion of the tool. Consequently, while this arrangement avoids the necessity for gripping the tool tightly in order to move it to the work-engaging position, the distance of the gripped portion of the tool from the workpiece remains unchanged and may still result in an undesirable degree of ulnar deviation. Another disadvantage of this arrangement is the requirement of sufficient inventory of sleeves of different sizes to fit barrels which vary in cross-section.

Another problem with in-line type tools relates to the distance of the hand-gripped portion of the tool from the end of the working portion. For example, it is not uncommon for the end of a wire-wrapping bit to be spaced as much as four inches from the barrel. A high degree of manual dexterity is required to maintain the working portion of the tool in alignment with the workpiece as the tool is moved downwardly. This problem also occurs with respect to the priorly-described plastic sleeve which it will be recalled is attached to the barrel with the flange displaced the same distance from the working portion as is the barrel.

What is required and what seemingly is not available in the prior art is an in-line tool which is adapted to be moved vertically in a repetitive manner between a rest position and a work position without causing operator fatigue and one which facilitates tool and workpiece alignment. The sought-after in-line tool should include provisions which are capable of easily being tailored and secured to any number of commercially available in-line tools.

SUMMARY OF THE INVENTION

The foregoing problems have been overcome by an ergonomical in-line tool of this invention which includes a barrel, a working portion which extends from said barrel and which is adapted to engage a workpiece and a jacket having at least a portion which covers and which is attached to the barrel. The jacket includes a length of relatively flexible substrate material, a plurality of reinforcing members which are attached to one surface of the substrate material and which extend along the barrel with an end of each being adjacent to the working portion. The jacket also includes a laterally extending portion which is disposed adjacent to the working portion and which is adapted to be engaged by the ulnar side of a user's hand to facilitate the application of forces to the tool to move it downwardly from the rest position to the work position.

As such, the jacket is capable of being supplied in a standard size which is sufficiently large to be fitted to the largest expected in-line tool and which is capable of being tailored to fit a smaller tool. This allows existing in-line tools to be retrofitted with the jackets of this invention. Also, the jacket is capable of being removed easily from the tool to allow its peripheral and longitudinal position relative to the barrel to be changed to suit a particular operator or operation.

In a preferred embodiment, the jacket comprises a length of relatively flexible substrate material having a plurality of elongated ribs adhered thereto. As a result, the jacket may be custom fitted to a particular in-line tool simply by cutting a length of the jacket from a supply along the substrate material between adjacent ribs. The length is cut to assure that the jacket will circumscribe the tool. Also, the jacket is positioned about the tool with a portion of the jacket being unsupported by the barrel to cause tabs which extend laterally from a few of the ribs to be adjacent to the working portion of the tool.

This arrangement has several benefits. Because of the relative positions of the tabs and the workpiece, the forearm is in a generally horizontal position with little or no deviation. Inasmuch as a relatively tight grip of the barrel becomes unnecessary to move the tool downwardly against the upward bias of a tool support system, operator fatigue is greatly reduced, particularly in view of the repetitive nature of the operation. A further benefit of this arrangement is the ability of the operator to grasp the tool at a location much closer to the working portion of the tool than before. This facilitates the alignment of the tool and the workpiece.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
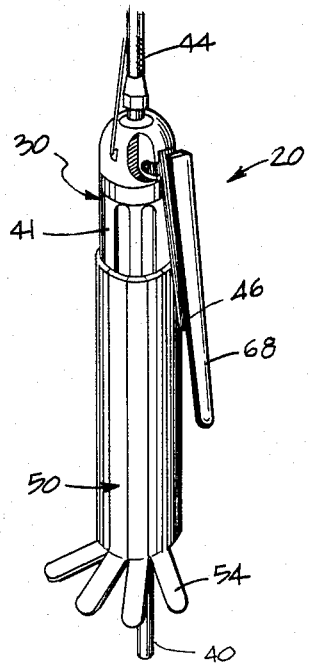
FIG. 1 is a perspective view of a jacketed in-line tool of this invention.
Figure 2:
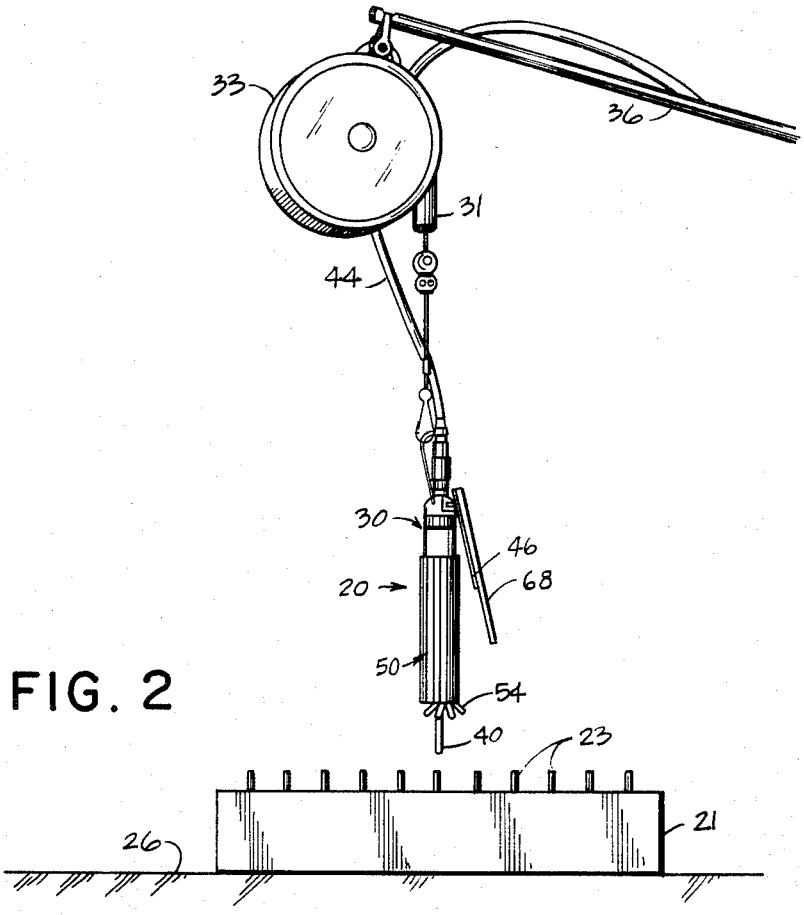
FIG. 2 is a perspective view showing a typical environment of use of the tool of this invention.

In FIG. 1, there is shown a jacketed in-line tool 20 of this invention which is used to perform a plurality of repetitive operations on a workpiece such as a terminal block 21, for example, which is shown in FIG. 2. The jacketed tool 20 may be used to wrap conductors about terminals 23—23 which are upstanding from the terminal block 21 or to turn screws into terminal posts of the block. As can be seen in FIG. 2, the terminal block 21 is supported on a horizontal surface 26 such that the terminals 23—23 are oriented vertically.

The jacketed tool 20 includes an in-line tool, which is designated generally by the number 30, and which is supported from a retractable cable 31 that is wound on a tool balancer 33. In order to position the tool 30 above the terminal block 21, the tool balancer 33 is supported from a rod 36 that extends from a frame (not shown). The tool balancer 33 causes the cable 31 to be spring-loaded to bias the tool 30 to a position above the workpiece.

The tool 30 is commonly referred to as an in-line tool and includes a working portion 40 which may be a wire wrapping bit, nut driver, or a screwdriver, for example, depending on its intended use. As is characteristic of in-line tools, the working portion 40 is mounted in an elongated barrel 41 which has a generally cylindrical shape. In many instances, the working portion 40 is driven by an air motor which is powered through a flexible conduit 44 (see FIG. 2). Typical of an in-line tool is a Model 662 in-line wire-wrapping tool as marketed by the Standard Pneumatic Company of Reno, Nev.

Figure 3:
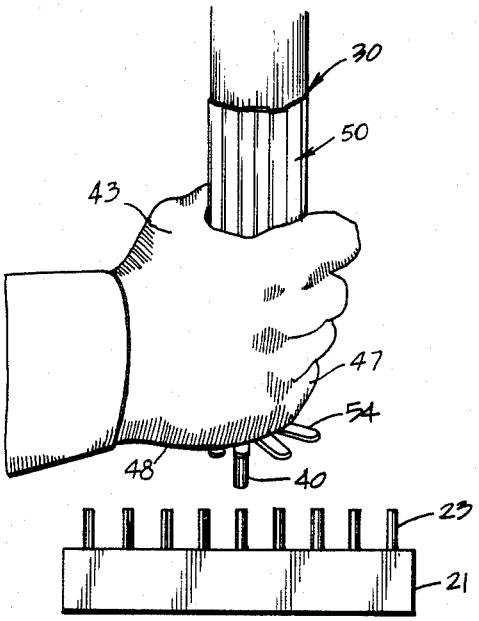
FIG. 3 is a view showing a user's hand grasping the jacketed in-line tool of this invention.

In using the tool 30 to wrap conductors about the terminals 23—23 of a terminal block 21, an operator grasps the barrel 41 with a hand 43 (see FIG. 3) and moves the tool to align the wire wrapping bit 40 with a terminal. Then the operator moves the bit 40 over the aligned terminal 23 and causes fingers to pull an actuator portion such as a trigger lever 46 toward the barrel 41 to control the air motor and cause the bit to be turned.

As was mentioned hereinbefore, the use of this kind of tool may become fatiguing to the operator. It will be recalled that the tool balancer 33 tends to maintain the tool 30 biased toward a rest position above the terminal block 21. In order to overcome the spring tension of the tool balancer 33 and move the tool downwardly, the operator tends to grasp the barrel 41 with a tighter grip than is necessary to hold the tool during its actual operation. This together with any ulnar deviation of the forearm results in undue compression of the fifth phalanges or little finger side 47 (see FIG. 3) in the carpal tunnel area adjacent to the ulnar side 48 of the hand 43.

This problem is overcome by the tool 20 of this invention which includes provisions for transforming the tool 30 into one which is ergonomically designed and which overcomes the problems of the prior art. The tool 30 is provided with a handle comprising a jacket which is designated generally by the numeral 50 (see FIGS. 1–3) and which is effective to permit the operator to move the tool 30 downwardly through forces applied by the ulnar side 48 of the gripping hand 43 rather than by the gripping fingers. The jacket system is designed so that after it is wrapped about and attached to an in-line tool by a craftsperson, the outer diameter of the wrapped barrel is not greater than about 1.5 inches to permit the tool to be grasped by anyone in the expected class of operators.

Figure 5:
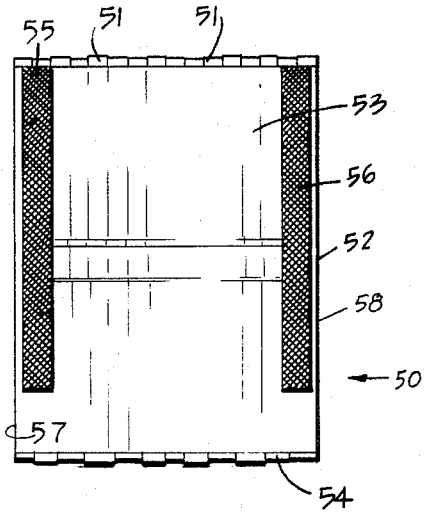
FIG. 5 is a perspective view of the length of material of FIG. 4 to show an inner surface thereof which is destined to engage the barrel to the tool.
Figure 4:
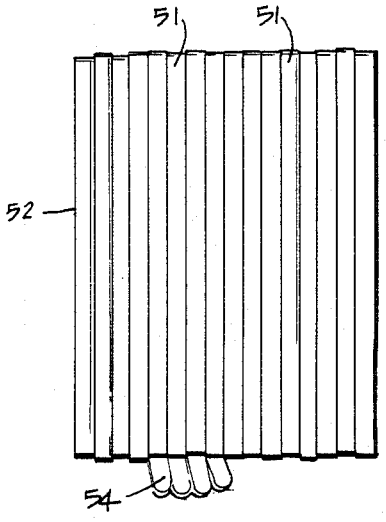
FIG. 4 is a perspective view of a length of material which is destined to be wrapped about a barrel of the tool to form a jacket.

As can be seen in FIGS. 4 and 5, the jacket 50 includes a length 52 of jacketing material comprising plurality of reinforcing members such as elongated ribs 51—51. The ribs 51—51 are adhered to a common substrate or backing 53, such as the well known duct tape, having an adhesive material on one side thereof. Generally, the ribs 51—51 are made of a metallic material such as, for example, anodized aluminum.

As can be seen in FIG. 4, each one of particular ribs 51—51 is formed to have a tab 54 extending laterally therefrom at one end of that rib. It should be observed that the tabs associated with the particular ribs are formed on one side of the length of jacket material. These tabs 54—54 are adapted to provide support for the ulnar side 48 of a user's hand which grips the jacketed tool barrel 41. It has been found that four tabs 54—54 are sufficient to provide effective engagement with the ulnar side of the user's hand.

Each tool is custom fitted about the periphery of its barrel 41 with a length 52 of jacket material. A craftsperson provides a length 52 of jacket material according to the dimensions of the in-line tool to be jacketed by cutting the common backing at a predetermined location. If the ribs 51—51 are too long for a particular tool, the craftsperson may cut the length 52 of jacketing material transversely of the ribs at their ends which are opposite to the ends on which the tabs 54—54 are formed. That length 52 of jacket material is wrapped about the barrel 41 with the elongated ribs 51—51 being disposed parallel to the longitudinal axis of the barrel.

Advantageously, a roll of jacket material may be provided for use with in-line tools in a particular manufacturing operation. The tabs 54—54 could be formed on a plurality of ribs, e.g. four ribs with adjacent pluralities being spaced apart to allow severence of a length of jacket material which is sufficient to enclose a barrel having the largest expected diameter. If there are too many ribs 51—51 in a length between pluralities of the tabs, some may be removed by cutting along the backing material 53.

Figure 6:
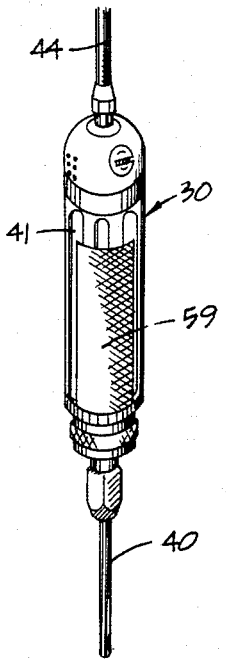
FIG. 6 is a perspective view of an in-line tool having a strip of securing material attached thereto.

After the length 52 of jacket material has been made available, provisions must be made for attaching the jacket 50 to the barrel 41 preferably in a manner so that it can be repositioned circumferentially or longitudinally with respect to the barrel. This is accomplished by positioning strips 55 and 56 of securing material adjacent to opposed ends 57 and 58, respectively, of the length 52 of jacket material (see FIG. 5) and by providing the barrel 41 with a strip 59 of securing material (see FIG. 6). Each of the strips 55 and 56 is positioned to extend lengthwise with the ribs 51—51 of the jacket.

Figure 7:
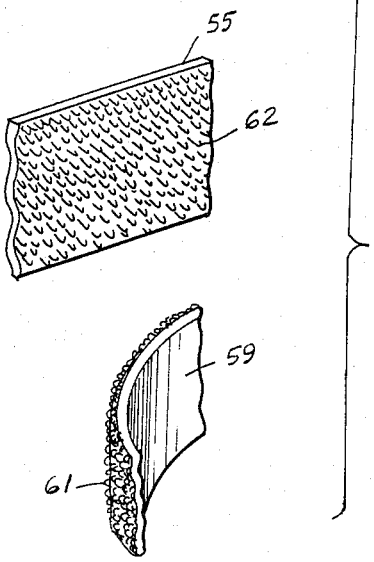
FIG. 7 is an enlarged view of portions of two strips of securing material having masses of looping and hooking elements upstanding therefrom.

The material which is used to provide the strips that are attached to the jacket and to the barrel 41 in the preferred embodiment of this invention is described in U.S. Pat. No. 2,717,437 which is incorporated by reference hereto. It includes a fabric having a foundation structure comprising woven threads that are cut a predetermined length to form a raised pile. The raised pile is made of a flexible, resilient material such as for example, nylon. Some of the threads in the pile such as those in the strip 59 are formed as looping elements 61—61 (see FIG. 7) while others are provided with material-engaging means adjacent their free ends by cutting the looping elements to produce hook-shaped ends. These, which are referred to as hooking elements 62—62, may form the pile in the strips 55 and 56. The material which is provided with the hooking or looping elements on one face is provided with an adhesive material on its other face so that it can be attached to the barrel 41 or to the common backing material 53 of the length 52 of jacketing material.

When two layers of this material are pressed into face-to-face relation with each other, a substantial percentage of the hooking elements 62—62 engage with the looping elements 61—61 to fasten the two layers together until they are separated by peeling forces. Accordingly, as the strips 55 and 56 which are attached to the backing material 53 are pressed into engagement with the strip 59, sufficient numbers of the hooking and looping elements 62—62 and 61—61 interlock together so that the fastened together, juxtaposed portions of the strips secure the jacket ends to the barrel strip 59.

Fastening systems such as those just-described are available commercially from the Velcro Corporation of New York under the designation VELCRO200 brand hook and loop type fasteners, and from the 3M Company under the designation SCOTCHMATE® brand hook and loop fasteners. See U.S. Pat. No. 4,249,689 for a system using hooking and looping elements which issued on Feb. 10, 1981 in the name of J. E. Voytko and which is incorporated by reference hereinto.

It should also be understood that while the hooking and looping elements 62—62 and 61—61 have been described as being woven, the invention also includes the use of belts of strips which are faced with material having molded hooking and looping elements. Also available from the 3M Company is a material known as a HEADLOK® II brand fastener having fields of headed stems which interlock when pressed together.

While the jacket 50 includes two strips which are faced with hooking elements and the barrel 41 is provided with a strip 59 which is faced with looping elements, the invention is not so limited. What is important is that one be provided with a plurality of flexible elements and the other be provided with a plurality of flexible elements which are capable of becoming interlocked. The elements in the one strip for example may comprise hooking elements and the other may comprise looping elements, or each strip may include both hooking and looping elements or the headed stem type elements mentioned hereinbefore.

After the strips of securing material for example have been attached to the barrel 41 and to the length 52 of jacket material, the craftsperson wraps the length of jacket material about the barrel 41 (see FIG. 8) in a manner to cause the ends 57 and 58 of the length to overlap the strip 59 of the VELCRO® material and to form a butt seam. The edge portions 57 and 58 of the jacket length are caused to be engaged with the strip 59 on the barrel 41 whereupon the hooking and looping elements interlock to hold the jacket to the barrel (see FIG. 1). A second strip 59 could be attached to the barrel 41 at a location, for example, which is diametrically opposed to the one shown in FIG. 6.

Aside from its usefulness in securing the jacket 50 to the barrel 41, the securing material such as that comprising the strips 55, 56 and 59 serves another important function. It tends to isolate somewhat the tool 30 from the jacket 50. As a result, it cushions the operator's hand from torsional forces that are generated during the operation of the tool and that otherwise would be transmitted to the operator's hand.

It should be apparent that the use of securing strips such as the strips 55, 56 and 59 is only one way in which the jacket 50 can be attached to the tool 30. Other arrangements are certainly possible and fall within the scope of this invention. However, the use of the securing strips is preferred in that their use facilitates installation and removal of the jacket 50.

Also of importance is the positioning of the jacket 50 on the barrel 41, both circumferentially and longitudinally. It will be recalled that particular ones of the ribs 51—51 each have a tab extending therefrom. In a preferred embodiment, the jacket 50 is positioned about the barrel 41 so that the tabs 54—54 are displaced circumferentially from the trigger lever 46. Accordingly, when the barrel 41 is gripped, the ulnar side 48 of the operator's hand 43 is generally displaced circumferentially from the trigger lever 46 which must be engaged by outer distal portions of the fingers to operate the tool 30 (see FIG. 1).

Longitudinally, the jacket 50 is attached to the barrel 41 such that a lower portion 66 (see FIG. 8) thereof is unsupported by the barrel. As such, the portion 66 encloses a portion of the working portion 40 of the tool. Consequently, the operator's hand is permitted to be significantly closer (see FIG. 3) to the workpiece than before, and the ergonomic address of the operator's hand and arm with respect to the tool is improved. This arrangement which may require the lengthening of the trigger lever 46 with an extension 68 (see FIGS. 1 and 2) provides support for the hand 43 without obstructing the operator's view of the terminal block 21. Also, this arrangement results in better operator control of the tool 30 to allow the tool to be aligned with each successive one of the terminals 23—23. As should be apparent, the operator is able to adjust the longitudinal position of the jacket 50 with respect to the barrel 41.

Figure 8:
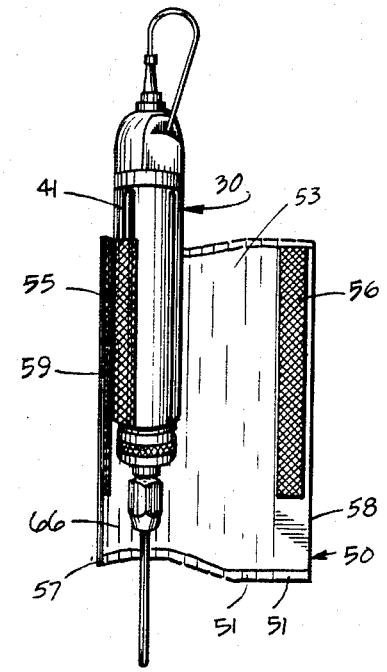
FIG. 8 is a perspective view showing the length of jacketing material of FIG. 4 being wrapped about the tool of FIG. 6.

For the embodiment shown in FIG. 8, the position of the strip 59 is determined in advance to insure the desired location of the tabs 54—54 of the length of jacket material relative to the trigger lever 46 of that particular tool. For tools of the same type and size, the craftsperson need only attach the strip 59 in the same position on each tool barrel 41. The jacket 50 is wrapped about each barrel to cause the butt seam to be in engagement with the strip 59.

Other variations are possible. For example, in FIG. 9, it can be seen that two ring strips 71 and 72 of securing material are positioned circumferentially at spaced locations about the barrel 41. This allows the jacket 50 to be positioned with the butt seam formed by the edges 57 and 58 capable of being at any circumferential location as opposed to the embodiment shown in FIG. 8. As a result, the positioning of the jacket 50 to cause the tabs 54—54 to be positioned to receive the ulnar side of a user's hand when the gripping fingers engage the actuator portion of the tool is accomplished easily. Should the tabs 54—54 not be positioned properly with respect to the actuator portion of the tool 30 after the jacket 50 has been wrapped about the barrel 41, the craftsperson need only peel strips 55 and 56 on the jacket 50 from the ring strips 71 and 72 and relocate the seam. For the embodiment shown in FIG. 8, an inaccurate positioning of the tabs 54—54 also would require the relocation of the strip 59. Accordingly, the embodiment of FIG. 9 appears to be a preferred embodiment insofar as the securing arrangement of the jacket to the barrel 41 is concerned.

Figure 10:
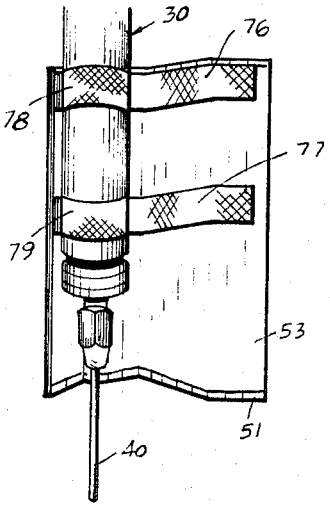
FIG. 10 is a detailed perspective view of a portion of the jacket and a still different arrangement for securing the jacket to the barrel of the tool.

In still another embodiment which is shown in FIG. 10, two spaced strips 76 and 77 of securing material are disposed along a length 52 of jacketing material. For this arrangement, the barrel 41 is provided with two strips 78 and 79 of securing material as in the embodiment shown in FIG. 9. This allows the jacket 50 to be wrapped about the barrel 41 and secured thereto with the seam between its two edges in any location about the periphery of the barrel as in the preferred embodiment.

Figure 9:
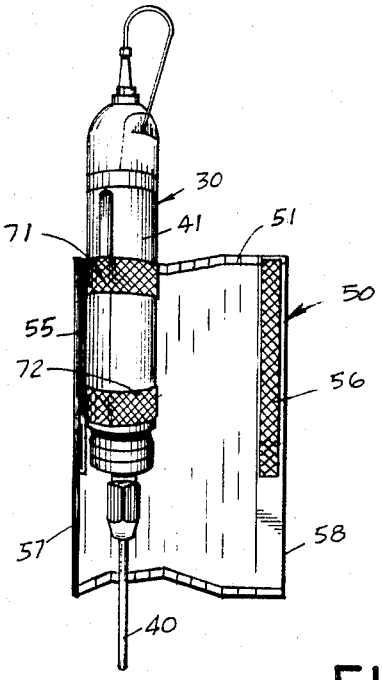
FIG. 9 is a perspective view showing a jacket having a different arrangement for being attached to the tool barrel.

As to the circumferential location of the tabs 54—54, the embodiment of FIG. 10 is as adaptable to change as is that of FIG. 9. However, the embodiment which is shown in FIG. 10 is particularly helpful to the proper positioning of the jacket along the length of the barrel 41. By using the two ring strips 76 and 77 on the inner surface of the jacket 50 and the two ring strips 78 and 79 on the barrel 41, the craftsperson merely attaches the jacket 50 to the barrel 41 so that the ring strips on the jacket engage those on the barrel. This automatically positions the tabs 54—54 with respect to the working portion 40 of the tool 30. Should the circumferential location not be correct, the craftsperson merely peels apart the strips and turns the jacket 50 to cause the tabs 54—54 to be in a desired location with respect to the actuator portion 46 of the tool.

The use a jacket of this invention transforms the tool 30 into an ergonomical in-line tool. As will be recalled, ulnar deviation of the forearm results in a compression in the carpal tunnel area. Also, an overly strong grip of an in-line tool on a repetitive basis may induce fatigue. Advantageously, the tool 20 of this invention decreases the degree of ulnar deviation and does not require a firm grip by the operator. The jacketed tool 20 allows a separation of operator movements, one for gripping the tool to guide the working portion 40 to the workpiece and to engage the actuator portion, and the other for moving the tool downwardly.

Further benefits are derived from the use of a jacket which is wrapped about the barrel 41 of an in-line tool in accordance with this invention. Not only is it adaptable to a whole host of commercially available in-line tools and adjustable to suit a particular operator, but the jacket is easily removable to facilitate repair of the tool or replacement of its working portion. Also, the jacket is capable of being releasably secured to the tool without modifying the barrel 41.

It is to be understood that the above-described arrangements are simply illustrative of the invention. Other arrangements may be devised by those skilled in the art which will embody the principles of the invention and fall within the spirit and scope thereof.

What is claimed is:

1. An in-line tool which is adapted to be moved vertically between a rest position and a work position, said tool comprising:

a barrel;

a working portion which extends from said barrel and which is adapted to engage a workpiece; and a jacket having at least a portion which covers and which is attached releasably to said barrel to allow said jacket to be in a predetermined position along said tool barrel with respect to said working portion, said jacket conforming to the contour of said barrel and including:

a length of relatively flexible substrate material; and a plurality of ribs which are attached to an outer surface of said substrate material and which extend along said barrel parallel to a longitudinal axis thereof with an end of each of said ribs being adjacent to said working portion, each said rib including a laterally extending tab which is disposed in a predetermined position adjacent to said working portion and which is adapted to be engaged by the ulnar side of a user's hand to facilitate the application of forces to said tool to move said tool downwardly from the rest position to the work position, said jacket having a portion which extends beyond said barrel to position said tabs adjacent to said working portion.

2. The tool of claim 1, wherein said barrel is provided with at least one strip having a plurality of elements of flexible, resilient material attached thereto and said jacket is provided with two spaced strips each having a plurality of flexible, resilient elements and being attached to a surface of said substrate material which is opposite to the outer surface thereof and capable of interlocking with the elements of said strip attached to said barrel when the strips are pressed together and of becoming disengaged from the elements of the strip attached to said barrel when the strips are peeled apart.

3. A jacket having at least a portion which is adatped to be secured to and to cover at least a portion of a barrel of an in-line tool to facilitate user movement of the tool vertically between a rest position and a work position, said jacket including:

a length of relatively flexible substrate material having one of its surfaces coated with an adhesive material and being capable of being wrapped about the barrel of the tool to cause the one surface to be oriented outwardly; and a plurality of ribs attached to one surface of the length of substrate material, which is coated with said adhesive material and which is adapted to be oriented outwardly with each of a predetermined number of said ribs having a tab extending laterally thereof at one of its ends, said tabs adapted to extend laterally from the barrel of the tool about which said jacket is adapted to be wrapped to provide support for the ulnar side of a user's hand during repetitive cycles of operation of the tool, said substrate material capable of being severed between adjacent ones of said ribs to allow a length of said substrate material to be fitted to a tool and wherein said jacket has sufficient strength to allow a portion of it to extend beyond a barrel of a tool toward a working portion of the tool.

4. The jacket of claim 3, wherein said ribs are made of a metallic material and are adapted to be oriented parallel to a longitudinal axis of the barrel of the tool when the jacket is wrapped about the tool.

5. The jacket of claim 3, wherein said jacket is provided with two spaced strips each having a plurality of flexible, resilient elements attached thereto and capable of interlocking with flexible resilient elements of at least one strip attached to the barrel when the strips are pressed together and of becoming disengaged from the elements of the strip attached to the barrel when the strips are peeled apart.

6. The jacket of claim 5, wherein said two strips are secured to a surface of the length of substrate material opposite to said surface to which said ribs are adhered, said two strips being transverse to said ribs and being spaced apart.

* * * * *